US005790023A

United States Patent [19]

Wolfgram et al.

[11] Patent Number: 5,790,023

[45] Date of Patent: Aug. 4, 1998

[54] APPARATUS AND METHOD FOR CONTROL OF ELECTRIC FENCE

[75] Inventors: Kirk W. Wolfgram, Rochester; Danny M. Ondler, Oronoco; Gerald D. Wyatt, Rochester, all of Minn.

[73] Assignee: Waters Instruments Inc., Rochester, Minn.

[21] Appl. No.: 684,685

[22] Filed: Jul. 19, 1996

Related U.S. Application Data

[63] Continuation of Ser. No. 361,805, Dec. 22, 1994, abandoned.

[51] Int. Cl.[6] ..... G08B 13/16

[52] U.S. Cl. ..... 340/564; 256/10

[58] Field of Search ..... 340/564; 256/10; 307/106, 107, 108, 132 R; 361/232

[56] References Cited

U.S. PATENT DOCUMENTS

| | | | |
|---|---|---|---|
| 3,392,285 | 7/1968 | Olson . | |
| 3,422,280 | 1/1969 | Olson . | |
| 3,439,183 | 4/1969 | Hurst, Jr. . | |
| 3,440,439 | 4/1969 | Nellis . | |
| 3,487,232 | 12/1969 | Daniels . | |
| 3,566,146 | 2/1971 | Breeze et al. | 307/132 M |
| 3,581,299 | 5/1971 | Schmidt | 340/649 |
| 3,655,994 | 4/1972 | Malme | 256/10 |
| 3,655,995 | 4/1972 | Malme . | |
| 3,717,802 | 2/1973 | Plevy et al. | 361/232 |
| 3,772,529 | 11/1973 | Boeing | 256/10 |
| 3,803,463 | 4/1974 | Cover | 361/232 |
| 3,868,545 | 2/1975 | Caron | 256/10 |
| 3,900,770 | 8/1975 | Kaufman | 361/156 |
| 3,988,594 | 10/1976 | Low et al. | 307/132 R |
| 4,037,269 | 7/1977 | Ferguson | 361/232 |
| 4,038,560 | 7/1977 | Newman et al. | 307/106 |
| 4,084,218 | 4/1978 | Kenney | 363/18 |
| 4,114,185 | 9/1978 | Gallagher | 361/232 |
| 4,167,036 | 9/1979 | Kenney | 363/61 |
| 4,200,809 | 4/1980 | Madsen | 256/10 |
| 4,242,715 | 12/1980 | Laird | 361/232 |
| 4,270,735 | 6/1981 | Gavin | 256/10 |
| 4,310,869 | 1/1982 | Niven | 361/232 |
| 4,316,232 | 2/1982 | Phillips | 256/10 |
| 4,337,496 | 6/1982 | Laird | 361/232 |
| 4,394,583 | 7/1983 | Standing | 307/108 |
| 4,396,879 | 8/1983 | Weinreich et al. | 320/1 |
| 4,417,301 | 11/1983 | Newman | 363/129 |
| 4,518,953 | 5/1985 | Hunter | 256/10 |
| 4,548,209 | 10/1985 | Wielders et al. | 607/4 |
| 4,560,827 | 12/1985 | Langlic et al. | 174/52.3 |
| 4,595,009 | 6/1986 | Leinders | 607/5 |
| 4,651,021 | 3/1987 | Hawkey | 307/106 |
| 4,691,084 | 9/1987 | Standing | 191/12.2 R |
| 4,800,883 | 1/1989 | Winstrom | 607/7 |
| 4,803,378 | 2/1989 | Richardson | 307/106 |
| 4,830,006 | 5/1989 | Haluska et al. | 607/4 |
| 4,859,868 | 8/1989 | McKissack | 256/10 |
| 5,193,048 | 3/1993 | Kaufman et al. | 361/232 |
| 5,223,749 | 6/1993 | Stegman | 307/106 |
| 5,381,298 | 1/1995 | Shaw et al. | 361/232 |

*Primary Examiner*—Brian Zimmerman
*Assistant Examiner*—Albert K. Wong
*Attorney, Agent, or Firm*—Fredrikson & Byron, P.A.

[57] ABSTRACT

An electric fence controller and method of controlling the energization of an electric fence. The controller includes a digital timing circuit which generates a digital signal to control the activation of a switching circuit for applying energy from an external power source across the primary winding of a transformer. The power source may be an alternating current source, the cycles of which are located by the timing circuit which activates the switching circuit after a selected number of cycles are counted driving an off-time period. Alternatively, the power source may be a direct current source and the timing circuit may include an oscillator and a counter for counting the number of oscillations and generating a digital signal which activates the switching circuit during an on-time period corresponding to a first selected number of oscillations, the switching circuit being inactive during an off-time period corresponding to a second selected number of oscillations.

20 Claims, 2 Drawing Sheets

APPARATUS AND METHOD FOR CONTROL OF ELECTRIC FENCE

This application is a continuation of application Ser. No. 08/361,805, filed on 22 Dec. 1994 and now abandoned.

FIELD OF THE INVENTION

The present invention relates to an electric fence controller and method of its use. More particularly, it relates to an electric fence controller having a digital timing circuit and to a method of energizing an electric fence with the controller.

BACKGROUND OF THE INVENTION

Electric fence controllers are devices which deliver high voltage electric charge to a wire fence. The purpose is to repel animals enabling them to be confined in an area surrounded by the fence.

The effectiveness with which an electric fence functions is due in large part to the timing of the electric shocks which are applied to the fence. The fence controller's timing circuit is thus of major importance to the fence controller's performance. The timing of the application of electric charge to the fence must be such that the charge is safe for both animals and humans and yet effective in controlling livestock.

Timing circuits that do not provide adequate off-time between shocks may be harmful to animals or humans that come into contact with the fence. As a result there are certain safety standards that must be met when designing an electric fence controller. For example, Underwriters Laboratory Publication U.L. 69 (Standard for Safety for Electric Fence Controllers) requires a minimum off-time of 1.00 seconds between shocks.

Although a larger time between shocks increases the safety of the fence, too much time between shocks cause the fence to lose effectiveness. The longer the time between shocks the more likely it is that an animal will pass through the fence during the fence controller's off-time. This is especially true of faster moving animals. For adequate control of livestock the accepted maximum off-time in the industry is 2 seconds. Typical off-times of fence controllers are between about 1 and 1.5 seconds.

In order to function both safely and effectively a fence controller must be able to consistently maintain the necessary balance between off-times and on-times. In the past, fence controllers have consisted of mechanical timing devices or analog timing circuits. Mechanical timing devices are subject to wear, corrosion and other stresses which cause mechanical devices to break down. Analog timing circuits suffer from a variety of reliability problems depending on their design. In such circuits off-time may be subject to fluctuation due to variations in supply voltage, humidity, temperature, and the condition of the fence. Thus, it would be desirable to provide an electric fence controller with the capability of accurately and consistently controlling both off-times and on-times of electrical charge supplied to the fence.

SUMMARY OF THE INVENTION

In accordance with the present invention there are disclosed several embodiments of a novel fence controller which include a digital timing circuit and a method of controlling an electric fence with the fence controller. In one embodiment there is disclosed an electric fence controller which includes a switching circuit adapted for connection to a separate power source. The controller utilizes a transformer having a primary winding adapted for connection to the power source when the switching circuit is activated. A digital timing circuit connected to the switching circuit is operative to cyclically generate a digital signal which activates the switching circuit during an on-time period, the switching circuit being inactive during an off-time period in the absence of the digital signal.

In this embodiment the power source may be an alternating current source, the switching circuit may be an SCR and the timing circuit may include a counter which counts cycles of the alternating current power source and generates the digital signal after a predetermined number of cycles have been counted, for example, 64 cycles. When the power source is an alternating current source the duration of the on-time and off-time are functions of the number of cycles counted by the counter.

In a further variation of this embodiment the power source may be a direct current source and the switching circuit may be a transistor. In this variation the digital timing circuit includes an oscillator adapted for connection to the power source. The oscillator generates a signal which oscillates at a predetermined frequency. The digital timing circuit further includes a counter connected to receive the signal from the oscillator. The counter counts the oscillations of the signal and produces one or more output signals indicative of the number of oscillations counted. A logic circuit is connected to receive the one or more output signals of the counter and generates a digital signal after a predetermined number of oscillations have been counted. In this variation the duration of the on-time and off-time are functions of the number of oscillations counted by the counter.

In a second embodiment the invention is an inductive discharge electric fence controller. The controller includes a transformer having a primary winding and a secondary winding, the secondary winding being adapted for connection to the fence. A switching circuit is provided and is adapted for connection between a separate direct current power source and the primary winding of the transformer. The switching circuit energizes the primary winding when the switching circuit is activated. An oscillator connected to the power source generates a signal which oscillates at a predetermined frequency. A counter is connected to receive the signal from the oscillator. The counter counts the oscillations and produces one or more signals indicative of the number of oscillations counted. A logic circuit is connected to receive the one or more output signals from the counter and has an output connected to the switching circuit. The logic circuit repeatedly generates digital output signals after a predetermined number of oscillations and multiples thereof have been counted. Each digital output signal activates the switching circuit during an on-time period. The switching circuit is inactive during an off-time period corresponding to the absence of the digital output signal. In this embodiment the duration of the on-time is equal to a first selected number of oscillations and the duration of the off-time is equal to a second selected number of oscillations.

In a further embodiment, the invention is a capacitive discharge electric fence controller. The controller includes a transformer having a primary winding and a secondary winding, the secondary winding being adapted for connection to the fence. A switching circuit is connected between the primary winding of the transformer and a storage capacitor. The switching circuit is operative to supply voltage stored in the storage capacitor across the primary winding of the transformer when the switching circuit is activated. A first rectifier is connected between an external alternating current power source and the storage capacitor for the purpose of providing energy to charge the storage capacitor. The controller includes a counter adapted for connection to the alternating current power source. The counter has an output connected to the switching circuit and is operative to count the cycles of the alternating current power source and to repeatedly generate a digital output signal after a predetermined number of the cycles and multiples thereof have been counted. Each digital output signal activates the switching circuit during an on-time period. The switching circuit is inactive during an off-time period corresponding to a period of time when the digital output signal is absent. In this embodiment the duration of the off-time may be equal to a selected number of cycles of the alternating current power supply. Additionally, the first rectifier may be a bridge rectifier. Further, the counter may include a half-wave rectifier adapted for connection to the alternating current power supply. The half-wave rectifier generates a half sine-wave, the pulses of which are counted by the counter.

In another embodiment, the invention is a method of controlling the energization of an electric fence. The method includes connecting a pulse generating circuit to a power source and counting the number of pulses generated by the pulse generating circuit. A digital signal is repeatedly generated after a predetermined number of pulses and multiples thereof have been counted. The method further includes activating a switching circuit to energize the primary winding of a transformer each time the digital signal is generated. Since the secondary winding of the transformer is connected to the fence a shock is produced each time the switching circuit is activated. The presence of the digital signal is indicative of the on-time of the energization of the fence and the absence of the digital signal is indicative of the off-time of the energization of the fence. The connecting step may include connecting a half-wave rectifier to an alternating current power source. In that event the number of pulses is equal to the number of cycles of the alternating current power source. The step of repeatedly generating a digital signal may include generating the digital signal after 64 pulses and multiples thereof have been counted. The method may include controlling the duration of the off-time by selecting the off-time to be equal to a selected number of pulses. Further, the connecting step may include connecting an oscillator to a direct current power source and the counting step may include counting the number of oscillations of the oscillator. In that variation the method may include controlling the duration of the on-time and off-time by selecting the on-time to be equal to a first number of oscillations and selecting the off-time to be equal to a second number of oscillations.

BRIEF DESCRIPTION OF THE DRAWINGS

The foregoing and other aspects of the present invention will be best appreciated with reference to the detailed description of the invention, which follows, when read in conjunction with the accompanying drawings wherein.

DETAILED DESCRIPTION OF THE INVENTION

Figure 1:
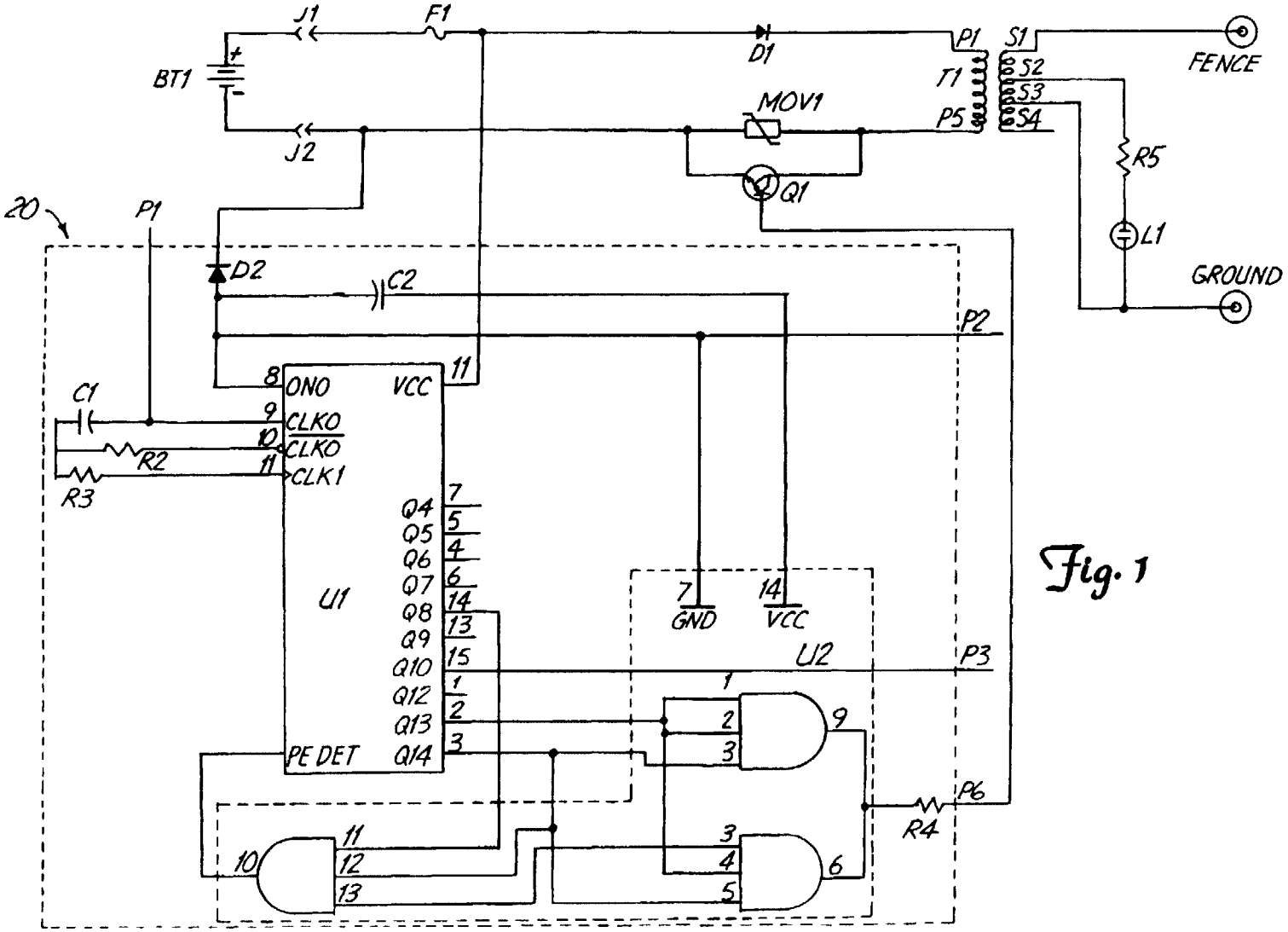
FIG. 1 is a circuit diagram of an inductive discharge type fence controller according to the present invention.

A circuit diagram of an inductive discharge fence controller in accordance with the present invention is shown in FIG. 1. The circuit is powered by a direct current power source. Typically, a six or twelve volt battery BT1 is used as the power source. The circuit may be conveniently connected to the battery by use of push on tabs J1/J2. Voltage from the battery is switched on and off across the primary winding of a transformer T1 in a manner controlled by transistor Q1. The base of transistor Q1 is connected to the output of a digital timing circuit 20 which turns transistor Q1 on and off in a controlled manner that will be discussed in more detail hereafter. Diode D1 is included to protect transistor Q1 from being damaged during conditions of reverse voltage which may occur, for example, if the battery is hooked up backwards. Voltage dependent resistor MOV1 is connected in parallel with transistor Q1 and is provided to protect transistor Q1 from any voltage surges which may be induced on the supply line. Fuse F1 may be included to provide the circuit with over current protection which may be needed, for example, should one of the circuit components fail.

The durations during which transistor Q1 is turned on (on-time) and off (off-time) are critical to the safe and efficient operation of the electric fence. When transistor Q1 is turned on, DC current from the battery passes through the primary winding of transformer T1 and energy is stored in the core of the transformer. When transistor Q1 is turned off, the flow of DC current to the transformer stops. Reverse electromotive force from the transformer's core is then delivered to the transformer's secondary winding and is applied to the fence. Proper control of the duration of the on-time of transistor Q1 is critical since the amount of energy delivered to the fence corresponds to the amount of energy delivered to the transformer's core. The amount of energy delivered to the transformer's core is a function of the duration (and magnitude) of the current pulse through the transformer's primary winding which is directly controlled by the on-time of transistor Q1. Likewise, proper control of the off-time of transistor Q1 is critical since the off-time of transistor Q1 controls the duration of time between energy pulses (shocks) being delivered to the fence. As previously discussed, too little time between shocks can be harmful to both animals and humans and too much time between shocks causes the fence to loose its effectiveness in control and confinement of livestock.

With continued reference to FIG. 1, the operation of the digital timing circuit 20 will now be explained. Integrated circuit U1 is connected to the battery at pins 16 (+/VCC) and 8 (−/GND). Diode D2 is provided between the negative terminal of the battery and pin 8 of U1 to protect the timing circuit from reverse voltage should the battery be inadvertently hooked up backwards. Diode D2 also serves to reference the voltage of the timing circuit above the emitter of transistor Q1 and especially above voltage fluctuations due to noise on the emitter. A capacitor C2 is connected between pins 16 and 8 and serves as a noise filter for the power supply to U1.

Integrated circuit U1 functions both as an oscillator (with capacitor C1 and resistors R2 and R3) and as a counter. In the preferred embodiment shown in FIG. 1, U1 is a type 4060 14-stage binary ripple counter with internal oscillator. It will be appreciated by those of skill in the art that other integrated circuits or discrete components may be substituted within the scope of the present invention. As noted, capacitor C1 and resistors R2 and R3 function in combination with integrated circuit U1 to make up the oscillator portion of the timing circuit. Capacitor C1, resistor R2 and resistor R3 are connected in parallel with capacitor C1 being connected to oscillator output pin 9 of U1, resistor R2 being connected to oscillator input pin 10 of U1 and R3 being connected to clock pin 11 or U1. Each oscillation of the square-wave signal which is generated by the oscillator portion of the circuit is counted by the counter section of U1. U1 generates a plurality of digital outputs of the count some of which are connected to a second integrated circuit U2.

In the preferred embodiment of the inductive discharge control circuit shown in FIG. 1, integrated circuit U2 is a type 4073 triple 3-input AND gate although other comparable integrated circuits or discrete components may be substituted. Pins 7 and 14 of U2 are connected to the negative and positive terminals of the battery, respectively. Output pin 2 of U1 is connected to pins 1, 2, 3, 4 and 13 of U2. Output pin 3 of U1 is connected to pins 8, 5 and 12 of U2. Output pin 14 of U1 is connected to pin 11 of U2. The logical output from the AND gates on pins 6 and 9 of U2 are summed and connected through resistor R4 to the base of transistor Q1 to provide the timing signal which turns transistor Q1 on and off in a manner well known to those of skill in the art. The logical output from the AND gate on pin 10 of U2 is connected to reset pin 12 of U1 and resets the counter section of U1 at the end of the on-time to restart the timing cycle.

In operation, when power is applied to U1, the oscillator begins to generate a square-wave signal which is counted by the counter section of U1. The quantity of square-waves counted by the counter section of U1 is stored at the output of the counter section of U1 in digital form (binary code). The digital output from U1 which provides information regarding the quantity of square-waves counted is connected to the input of the logic gates in U2. U2 provides the logic to determine the number of square-waves that are counted during the off-time, and the number of square-waves that are counted during the on-time. At the end of the on-time, which is determined by counting the correct number of square-waves, U2 provides a reset signal back to U1 causing the counter section of U1 to reset to 0 and the cycle repeats itself. U2 is also connected to the base of Q1 which in turn controls the supply current to T1.

When the DC current that is supplied to the transformer's primary winding is shut off by turning off Q1, a high voltage pulse is induced in the secondary winding of the transformer. This high voltage pulse is applied to the fence. Resistor R5 and neon lamp L1 are connected between a portion of the secondary winding and ground. Lamp L1 provides a visual indication of the presence of voltage at the fence.

It will be apparent to those skilled in the art that by varying the clock frequency and/or the output and input connections of U1 and U2, the duration of the on-time and off-time and their relationship to one another can be preselected. The on-time and the off-time are mathematical functions of one another based upon the logic circuitry used. Since the timing circuit is digital and has a regulated and filtered power supply it is not subject to noise problems which effect analog circuits. Further, the reliability and accuracy of the fence controller is enhanced due to the fact that, since the counter runs continuously, it is not necessary to reset components during the control of on-time and off-time durations.

Figure 2:
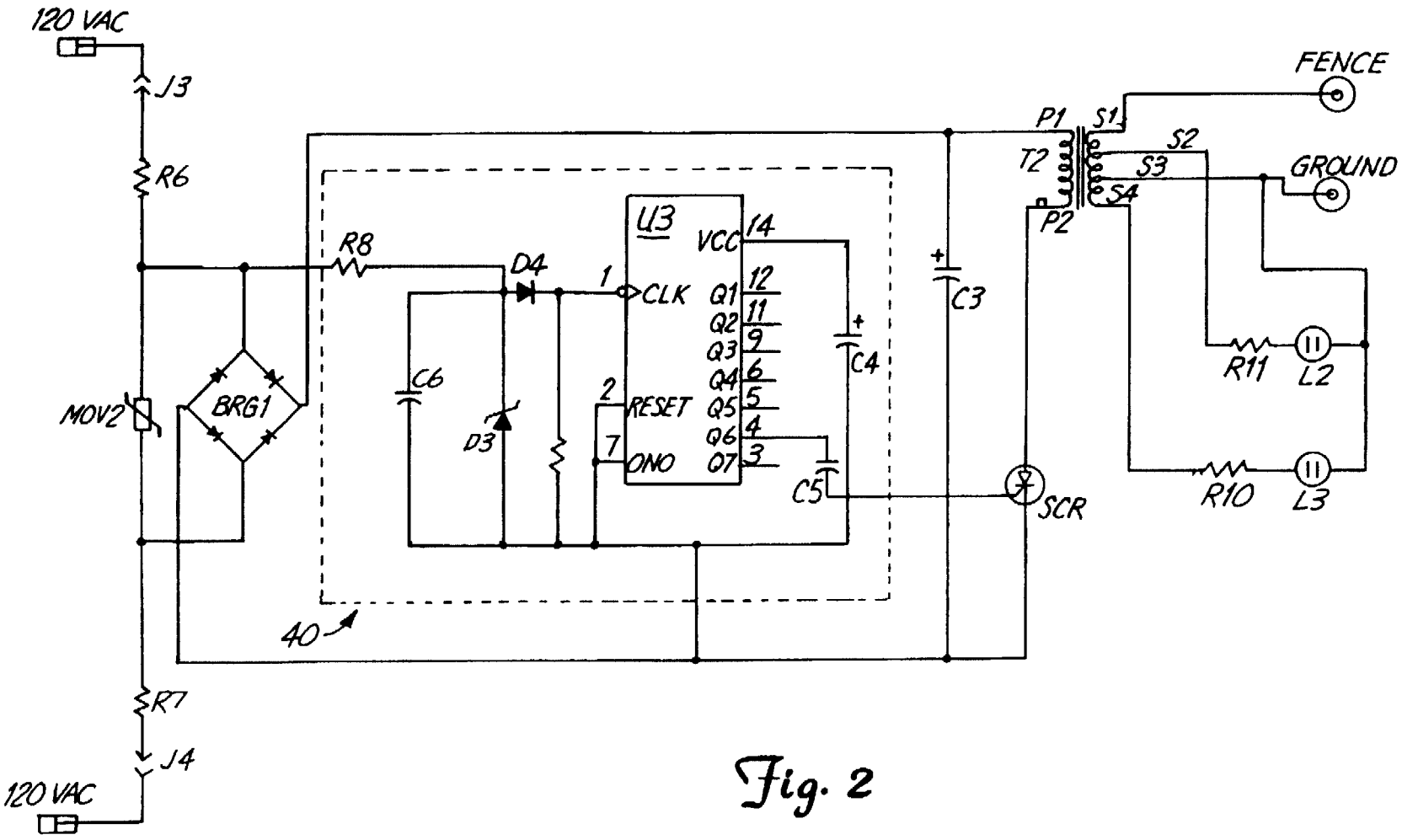
FIG. 2 is a circuit diagram of a capacitive discharge type fence controller according to the present invention.

FIG. 2 is a circuit diagram of a further embodiment of the invention relating to a capacitive discharge fence controller. In this embodiment the circuit is powered by an alternating current power supply, typically, line voltage of 120 volts. The power supply is connected through resistors R6 and R7 to a full-wave bridge rectifier BRG1. Voltage dependent resistor MOV2 is connected across BRG1 and provides over-voltage protection from surges induced on the supply line. Rectifier BRG1 converts the alternating current voltage to direct current voltage which is applied across capacitor C3 causing capacitor C3 to charge. The primary winding of a transformer T2 and an SCR are connected in series across the storage capacitor C3. A timing circuit which will be described in more detail hereafter is connected to the gate of the SCR and controls the rate at which the SCR turns on. Resistors R6 and R7 limit the rate of charge and the current to capacitor C3. Resistors R6 and R7 also limit the current to the SCR at the time of discharge to allow the SCR to turn off. Each time the SCR turns on the energy stored in capacitor C3 is applied across the primary winding of the transformer. When the SCR turns off a voltage pulse is induced across the secondary winding of the transformer and is applied as a shock between a fence connection and ground. Lamp L2 and resistor R11 are connected in series between ground and a portion of the secondary winding of the transformer. Lamp L3 and resistor R10 are connected in a similar arrangement. Lamps L2 and L3 provide a visual indication of voltage present at the secondary winding of the transformer.

The gate of the SCR is connected to the output of a digital timing circuit 40. Timing circuit 40 includes an integrated circuit U3. In the preferred embodiment shown in FIG. 2, U3 consists of a type 4024 7-stage binary ripple counter, although it should be apparent that other equivalent integrated circuits or discrete components may be used. The alternating current power supply is connected to the clock pin 1 and power supply pin 14 of U3 through resistor R8, zener diode D3 and diode D4. Resistor R8 and diodes D3 and D4 combine to form a regulated square wave generator for the power supply(VCC) and clock(CLK) of integrated circuit U3. Capacitor C6 is connected in parallel with diode D3 and filters out noise from the alternating current line. Resistor R9 functions to provide a positive pull down for U3 during the negative cycle of the alternating current power supply.

Integrated circuit U3 operates to count the number of half-wave cycles of the alternating current power supply which typically operates at 50/60 Hz. U3 begins to count the square wave pulses on the clock line as soon as its supply voltage exceeds its minimum operating voltage. The count continues until all output lines are high. Once all output lines are high the count wraps around and causes all output lines to go to the low state and the counting cycle continues. The Q6 output of U3 at pin 4 is connected through a capacitor C5 to the gate of the SCR. This causes an output signal to be delivered to the gate of the SCR every 64 square-wave pulses (i.e. every 64 half-cycles of the AC line source).

Each time the Q6 output of U3 goes high (i.e. every 1.280 seconds at 50 Hz/every 1.067 seconds at 60 Hz) the coupling capacitor C5 sources current from the Q6 output line of U3 to the SCR's gate. This causes the SCR to turn on and operate normally in the first quadrant. Once the SCR turns on, the charge stored in capacitor C3 is delivered to the primary winding of transformer T2 and the fence controller delivers a shock in a manner similar to other capacitive discharge fence controllers.

Each time the Q6 output of U3 goes low coupling capacitor C5 sinks current from the SCR's gate. Since the SCR is in the third quadrant, the SCR's gate requires approximately ten times the current required to turn the SCR on in the first quadrant. When the SCR is in the third quadrant the sink current of U3 is inadequate to turn the SCR on and no other change in the circuit takes place.

From the foregoing detailed description of specific embodiments of the invention, it should be apparent that various embodiments of the invention applicable to both DC inductive discharge fence controllers and AC capacitive discharge fence controllers has been disclosed. In all embodiments the fence controller utilizes a digital timing circuit to precisely and accurately control the generation of timing signals. The digital timing circuit is more accurate than either analog timing circuits or mechanical timing devices. Although particular embodiments of the invention have been disclosed herein in detail, this has been done for the purpose of illustration only, and is not intended to be limiting with respect to the scope of the appended claims, which follow. In particular, it is contemplated by the inventors that various substitutions, alterations and modifications may be made to the embodiments of the invention without departing from the spirit and scope of the invention as defined by the claims. For instance, the choice of particular circuit components or the substitution of components, discrete or integrated, with those of equivalent function are believed to be a matter of routine for a person of ordinary skill in the art with knowledge of the embodiments disclosed herein.

We claim:

1. An electric fence controller for use with a power source for applying electrical energy pulses to a fence, the controller comprising:

a switching circuit adapted for connection to the power source, the switching circuit being switchable between an on state during an on-time period and an off state during an off-time period;

a transformer having a primary winding connected to the switching circuit such that the primary winding is electrically energized by the power source when the switching circuit is on and such that the primary winding is isolated from the power source when the switching circuit is off, the transformer having a secondary winding for connection to the fence;

a digital logic timing circuit connected to the switching circuit, the timing circuit being a digital logic circuit operative to cyclically generate a digital signal which turns the switching circuit on in the presence of the digital signal, each digital signal resulting in an energization pulse being applied to the fence, the switching circuit being off in the absence of the digital signal, the cyclic generation of the digital signal resulting in a regular pattern of energization pulses being applied to the fence.

2. The fence controller of claim 1 wherein the power source is an alternating current source, the switching circuit comprises a SCR and wherein the timing circuit includes a counter which counts cycles of the alternating current power source, the timing circuit being operative to generate the digital signal after a predetermined number of cycles have been counted.

3. The fence controller of claim 2 wherein the predetermined number of cycles is 64.

4. The fence controller of claim 2 wherein the durations of the on-time and off-time depend on the number of cycles counted by the counter.

5. The fence controller of claim 1 wherein the power source is a direct current source, the switching circuit is a transistor and wherein the timing circuit comprises:

an oscillator adapted for connection to the power source, the oscillator generating a signal which oscillates at a predetermined frequency;

a counter connected to receive the signal from the oscillator and operative to count the oscillations of the signal and to produce at least one output signal indicative of the number of oscillations counted; and a logic circuit connected to receive the at least one output signal of the counter, the logic circuit being operative to generate the digital signal after a predetermined number of oscillations have been counted.

6. The fence controller of claim 5 wherein the durations of the on-time and off-time depend on the number of oscillations counted by the counter.

7. An inductive discharge electric fence controller for use with a direct current power source for applying electrical energy pulses to a fence, the controller comprising:

a transformer having a primary winding and a secondary winding, the secondary winding being adapted for connection to the fence;

a switching circuit adapted for connection between the direct current power source and the primary winding of the transformer, the switching circuit being switchable between an on state during an on-time period and an off state during an off-time period, such that the primary winding is electrically energized by the direct current power source when the switching circuit is on and such that the primary winding is isolated from the power source when the switching circuit is off;

an oscillator adapted for connection to the direct current power source and operative to generate a signal which oscillates at a predetermined frequency;

a counter connected to receive the signal from the oscillator and operative to count the oscillations and produce one or more signals indicative of the number of oscillations counted; and a logic circuit having an input connected to receive the one or more output signals from the counter and an output connected to the switching circuit, the logic circuit being operative to cyclically generate digital output signals after a consistent number of oscillations and multiples thereof have been counted, each digital output signal being operative to turn the switching circuit on during the on-time period corresponding with the presence of the digital output signal, the switching circuit being off during the off-time period corresponding to the absence of the digital output signal, the cyclic generation of the digital signal resulting in a regular pattern of energization pulses being applied to the fence.

8. The fence controller of claim 7 wherein the duration of the on-time is equal to a first selected number of oscillations and the duration of the off-time is equal to a second selected number of oscillations.

9. A capacitive discharge electric fence controller for use with an alternating current power source for applying electrical pulses to a fence, the controller comprising:

a transformer having a primary winding and secondary winding, the secondary winding being adapted for connection to the fence;

a storage capacitor;

a switching circuit connected between the primary winding of the transformer and the storage capacitor, the switching circuit being operative to supply voltage stored in the storage capacitor across the primary winding of the transformer when switching circuit is activated;

a first rectifier adapted for connection between the alternating current power source and the storage capacitor, the rectifier being operative to charge the storage capacitor; and a counter adapted for connection to the alternating current power source and having an output connected to the switching circuit, the counter operative to count the cycles of the alternating current power source and to repeatedly generate a digital output signal after a predetermined number of the cycles and multiples thereof have been counted, each digital output signal activating the switching circuit during an on-time period corresponding with the presence of the digital output signal, each digital output signal resulting in an energization pulse being applied to the fence, the switching circuit being inactive during an off-time period corresponding to a period of time when the digital output signal is absent and resulting in the application of a regular pattern of energization pulses to the fence.

10. The fence controller of claim 9 wherein the duration of the off-time is equal to a selected number of cycles of the alternating current power supply.

11. The fence controller of claim 9 wherein the first rectifier is a bridge rectifier.

12. A method of controlling the energization of an electric fence comprising:

connecting the primary winding of a transformer to a power source;

generating regularly recurring pulses;

counting the number of pulses generated;

repeatedly generating a digital signal after a predetermined number of pulses and multiples thereof have been counted; and activating a switching circuit to energize the primary winding of the transformer each time the digital signal is generated, the secondary winding of the transformer being connected to the fence, the presence of the digital signal being indicative of the on-time of the energization of the primary winding of the transformer and resulting in an energization pulse being applied to the fence, the absence of the digital signal being indicative of the off-time of the energization of the primary winding of the transformer and resulting in the application of a regular pattern of energization pulses to the fence.

13. The method of claim 12 wherein the connecting step comprises connecting a rectifier to an alternating current power source such that a pulse is generated for each cycle of the alternating current power source.

14. The method of claim 13 wherein the step of repeatedly generating a digital signal comprises generating the digital signal after 64 pulses and multiples thereof have been counted.

15. The method of claim 13 further comprising controlling the duration of the off-time by selecting the off-time to be equal to a selected number of pulses.

16. The method of claim 12 wherein the connecting step comprises connecting an oscillator to a direct current power source and the counting step comprises counting the number of oscillations of the oscillator.

17. The method of claim 16 further comprising controlling the duration of the on-time and off-time by selecting the on-time to be equal to a first number of oscillations and selecting the off-time to be equal to a second number of oscillations.

18. The fence controller of claim 7 wherein the switching circuit is a transistor.

19. The fence controller of claim 9 wherein the predetermined number of cycles is 64.

20. The fence controller of claim 9 wherein the duration of the on-time and off-time depends an the number of cycles of the alternating current power source counted by the counter.

* * * * *